US005918093A

United States Patent [19]

Kim

[11] Patent Number: 5,918,093

[45] Date of Patent: Jun. 29, 1999

[54] DEVELOPING SOLUTION SUPPLYING SYSTEM FOR WET TYPE DEVELOPER

[75] Inventor: Jong-woo Kim, Yongin, Rep. of Korea

[73] Assignee: Samsung Electronics Co., Ltd., Kyungki-Do, Rep. of Korea

[21] Appl. No.: 09/088,484

[22] Filed: Jun. 2, 1998

[30] Foreign Application Priority Data

Aug. 27, 1997 [KR] Rep. of Korea ..... 97-41611

[51] Int. Cl.[6] ..... G03G 15/10

[52] U.S. Cl. ..... 399/237; 366/273; 399/105

[58] Field of Search ..... 399/57, 58, 105, 399/106, 237, 238; 366/241, 273, 274; 347/85, 86

[56] References Cited

U.S. PATENT DOCUMENTS

| | | | |
|---|---|---|---|
| 3,876,282 | 4/1975 | Schon et al. | 399/238 |
| 5,451,987 | 9/1995 | Perrin | 347/85 X |
| 5,530,529 | 6/1996 | Henderson et al. | 399/57 X |
| 5,539,503 | 7/1996 | Johnson | 399/237 |
| 5,816,058 | 10/1998 | Lee et al. | 366/273 X |

*Primary Examiner*—William Royer
*Assistant Examiner*—Sophia S. Chen
*Attorney, Agent, or Firm*—Sughrue, Mion, Zinn, Macpeak & Seas, PLLC

[57] ABSTRACT

A developing solution supplying system for a wet type developer includes an ink cartridge for storing ink, a carrier storage tank for storing liquid carrier, and a mixing tank located adjacent to the ink cartridge having a bulkhead therebetween for storing a developing solution. An actuator imparts interlocking rotation to a first agitating blade rotatably installed in the mixing tank and a second agitating blade rotatably installed in the ink cartridge opposite the first agitating blade to simultaneously agitate, by a single driving source, the solutions in the ink cartridge and the mixing tank.

8 Claims, 2 Drawing Sheets

DEVELOPING SOLUTION SUPPLYING SYSTEM FOR WET TYPE DEVELOPER

BACKGROUND OF THE INVENTION

1. Field of the Invention

The present invention relates to a developing solution supplying system for a wet type developer, and more particularly, to a developing solution supplying system for a wet type developer having an improved agitator for maintaining solution in an evenly distributed concentration.

2. Description of the Related Art

A wet type developer develops a latent image by supplying a developing solution to a photosensitive medium, such as a photosensitive belt, on which an electrostatic latent image is formed. The wet type developer includes a developing unit for supplying the developing solution to the photosensitive medium, and a developing solution supplying system for continuously supplying a developing solution having a toner concentration within a predetermined range to the developing unit. The developing solution has a toner concentration of approximately 3–5 wt %. This concentration is achieved by mixing an undiluted ink solution having a powder toner concentration of about 9–10 wt %, with a liquid carrier. The developing solution supplying system includes an ink cartridge for storing the undiluted ink solution, a carrier storage tank for storing the liquid carrier, and a mixing tank for mixing the undiluted ink solution with the liquid carrier at a predetermined ratio. An agitator, for agitating the powder toner to prevent it from settling out of the solutions stored in the ink cartridge and the mixing tank, is installed in each of the ink cartridge and the mixing tank.

However, in the conventional developing solution supplying system, the number of components constituting the system is disadvantageously large since independent agitators are separately installed in each of the ink cartridge and the mixing tank. Further, when numerous colors of ink are used, such as in a color laser printer for example, the required number of agitators is at least twice the number of colors of ink. Thus, the structure of the system is complicated.

SUMMARY OF THE INVENTION

To solve the above problems, it is an objective of the present invention to provide a developing solution supplying system for a wet type developer having an improved agitator for agitating a solution in an ink cartridge or a mixing tank.

To achieve the above objective, a developing solution supplying system for a wet type developer, comprises: an ink cartridge for storing ink, a carrier storage tank for storing liquid carrier; and a mixing tank which stores a developing solution obtained by mixing the ink in the ink cartridge with the carrier in the carrier storage tank in a predetermined ratio. The mixing tank is located adjacent to the ink cartridge having a bulkhead therebetween. A first agitating blade is rotatably installed in the mixing tank, and a second agitating blade is rotatably installed in the ink cartridge opposite the first agitating blade. An actuator, separated from the first and second agitating blades, is provided for imparting interlocking rotation to the first and second agitating blades.

In a developing solution supplying system according to another embodiment of the present invention, the agitator comprises a shaft which in rotatably installed through the bulkhead such that a first end of the shaft is provided in the mixing tank and a second end of the shaft is provided in the ink cartridge. A sealing member seals the portion of the bulkhead through which the shaft penetrates. A first agitating blade is installed on the first end of the shaft, and a second agitating blade is installed on the second end of the shaft. An actuator is provided to impart rotation to one of the first and the second agitating blades.

The above and other features of the invention including various and novel details of construction and combination of parts will now be more particularly described with reference to the accompanying drawings and pointed out in the claims. It will be understood that the particular developing solution supplying system embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENTS

Figure 1:
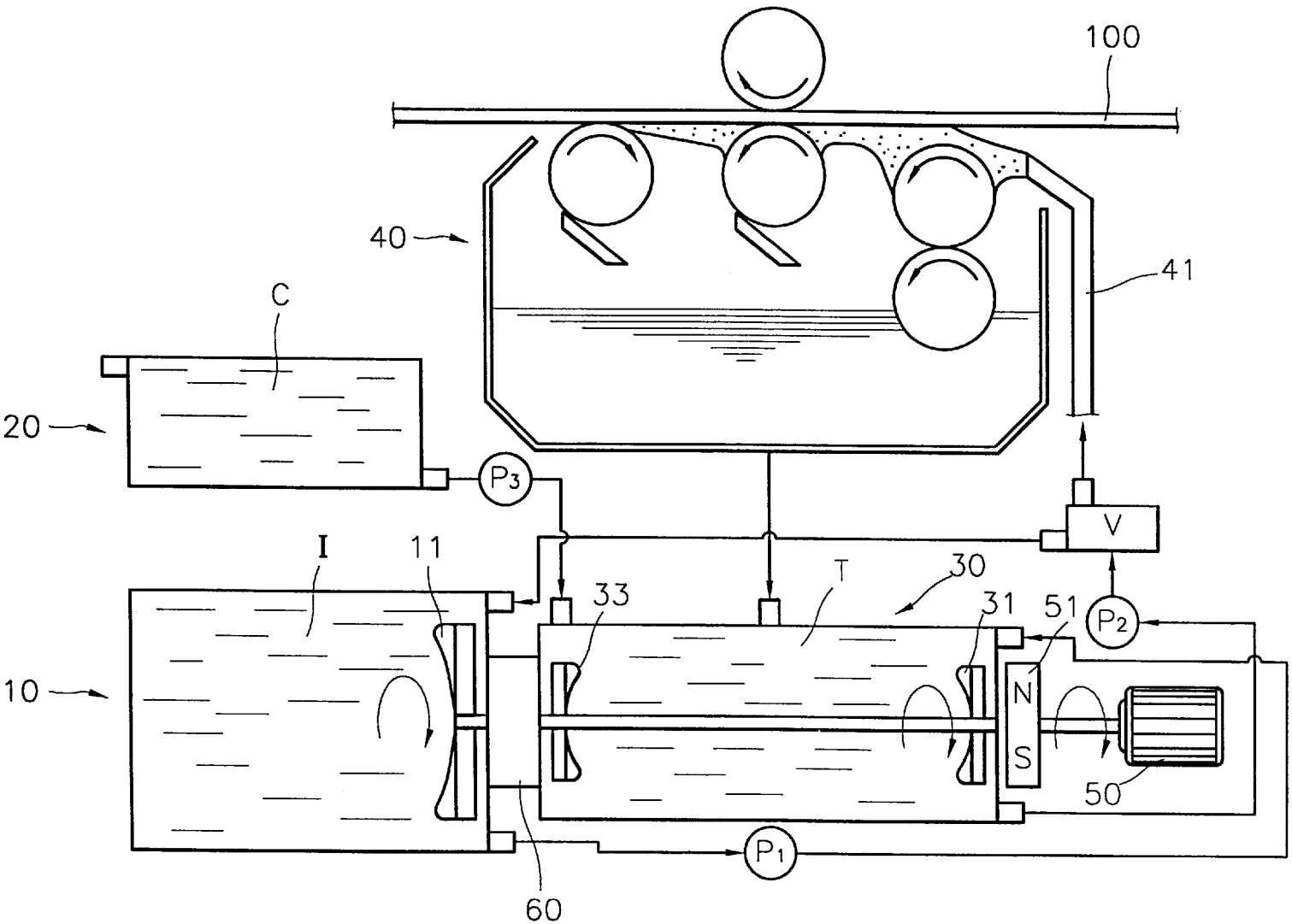
FIG. 1 illustrates a first embodiment of a developing solution supplying system according to the present invention.

Referring to FIG. 1, a first embodiment of the present developing solution supplying system includes an ink cartridge 10 filled with an ink I of a predetermined color, and a carrier storage tank 20 filled with a liquid carrier C. A mixing tank 30 is provided adjacent the ink cartridge 10 with a bulkhead 60 provided therebetween. The mixing tank 30 stores a developing solution T obtained by mixing the ink I from the ink cartridge 10 with the liquid carrier C from the carrier storage tank 20 in a predetermined ratio. An agitator is installed to agitate the ink I and developing solution T stored in the ink cartridge 10 and the mixing tank 30, respectively. The agitator comprises first agitating blades 31 and 33 rotatably installed in the mixing tank 30, and a second agitating blade 11 rotatably installed in the ink cartridge 10 opposite the first agitating blades 31 and 33. Accordingly, the bulkhead 60 is located between the second agitating blade 11 and the first agitating blades 31 and 33. The first and second agitating blades 31, 33 and 11 are made of a material which can be magnetized by a magnetic force. An actuator is installed separated from the first and second agitating blades 31, 33 and 11. The actuator includes a magnet member 51 facing the first agitating blades 31 and 33 and a driving motor 50 for rotating the magnet member. In this way, the first and second agitating blades 31, 33 and 11 are interlockingly rotatable.

When the driving motor 50 rotates the magnet member 51, the first agitating blades 31 and 33 are rotated by a magnetic force of the magnet member 51. The second agitating blade 11 is also rotated by the magnetic force of the first agitating blades 31 and 33. That is, when the magnet member 51 rotates, the first agitating blades 31 and 33 and the second agitating blade 11 are rotated in an interlocked fashion. Such an interlocked rotation of the first and second agitating blades 31, 33 and 11 agitates the solutions contained in the mixing tank 30 and the ink cartridge 10. Accordingly, the powder toner does not settle out of the solutions and a constant concentration distribution is maintained. Therefore, the developing solution supplying system according to the first embodiment of the present invention can simultaneously rotate the first and second agitating blades 31, 33 and 11 in the mixing tank 30 and the ink cartridge 10, respectively, via a single driving source. In the present embodiment, the magnet member 51 is installed to drive the first agitating blades 31 and 33. Alternatively, the second agitating blade 11 may be driven to rotate the first agitating blades 31 and 33.

Reference numerals P1, P2 and P3 each denote a pump for pumping respective solutions through a predetermined passage, and reference numeral V denotes a valve for supplying a developing solution pumped from the mixing tank 30 to a developing unit 40 or for selectively returning the pumped developing solution to the ink cartridge 10. Reference numeral 41 denotes a supply line for supplying the developing solution T to the developing unit 40, and reference numeral 100 denotes a photosensitive belt.

Figure 2:
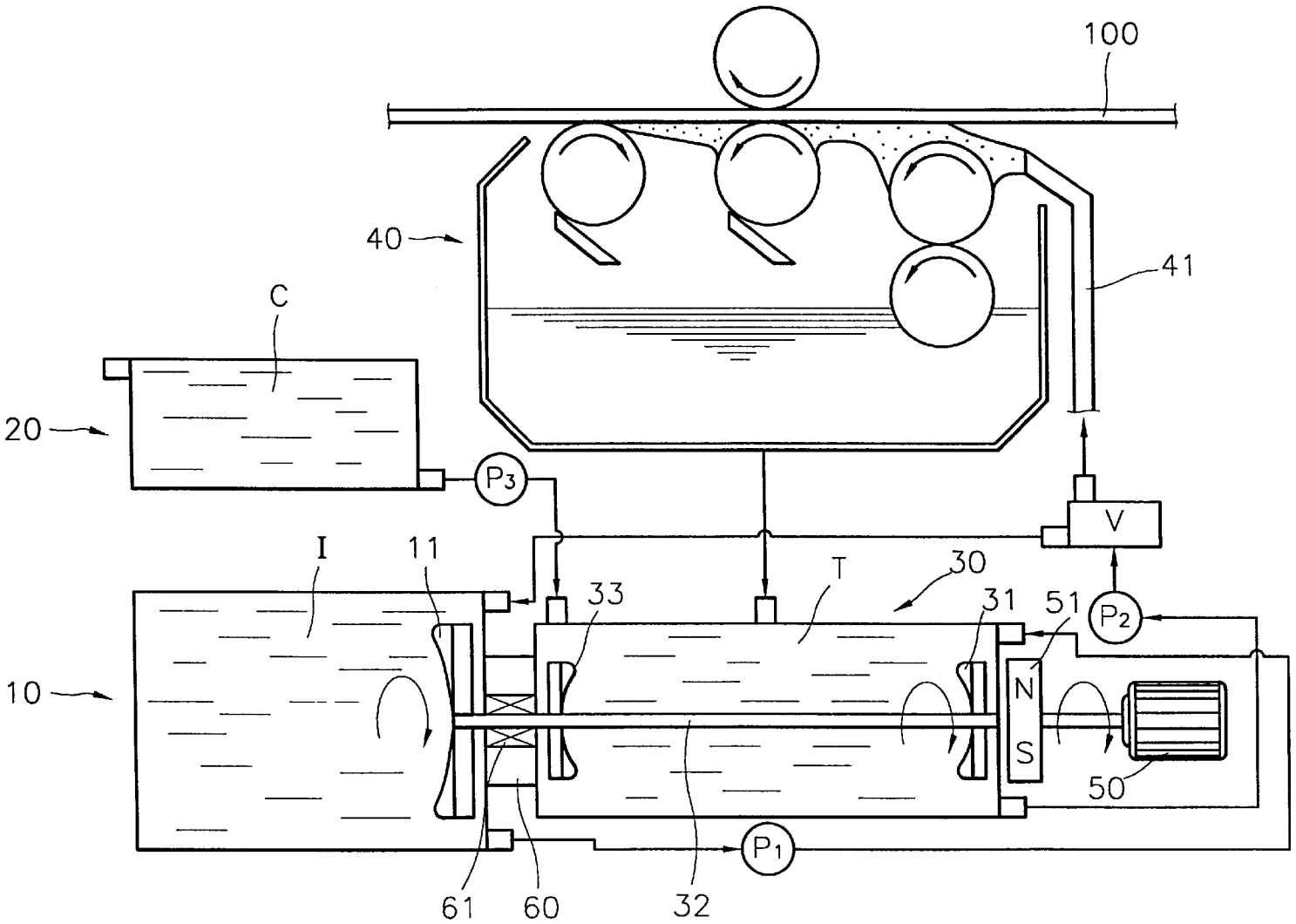
FIG. 2 illustrates a second embodiment of a developing solution supplying system according to the present invention.

FIG. 2 illustrates a second embodiment of a developing solution supplying system according to the present invention. The same reference numerals indicate the same members as those in the previous first embodiment of FIG. 1. An agitator according to the present embodiment further includes a shaft 32 rotatably installed through the bulkhead 60 so that one end of the shaft 32 is provided in the mixing tank 30 and the other end of the shaft 32 is provided in the ink cartridge 10. A sealing member, i.e., an O-ring 61, is provided for sealing the portion of the bulkhead 60 through which the shaft 32 penetrates. The first agitating blades 31 and 33 are installed on the end of the shaft 32 in the mixing tank 30, and the second agitating blade 11 is installed on the end of the shaft 32 in the ink cartridge 10. The magnet member 51 and the driving motor 50 for rotating the first agitating blades 31 and 33 are the same as those in the first embodiment. Here, the first agitating blades 31 and 33 are formed of a magnetizable material which can be rotated by the magnetic force of the magnet member 51.

When the magnet member 51 is rotated by the driving motor 50, the first agitating blades 31 and 33 are rotated by the magnetic force of the magnet member 51. The shaft 32 is rotated together with the first agitating blades 31 and 33. Thus, the second agitating blade 11 fixed to the end of the shaft 32 in the ink cartridge 10 is also rotated. Therefore, in the developing solution supplying system according to the second embodiment, the first and second agitating blades 31, 33 and 11 in the mixing tank 30 and the ink cartridge 10, respectively, are simultaneously rotated by a single driving source.

The ink cartridge 10 and the mixing tank 30 can be manufactured as separate members and then assembled together. It is preferable that these components facilitate the replacement thereof.

As described above, the developing solution supplying system according to the present invention can simultaneously agitate the solutions in an ink cartridge and a mixing tank using a single driving source. Thus, the number of parts can be reduced, and the structure of an entire developer can be simplified.

What is claimed is:

1. A developing solution supplying system for a wet type developer, comprising:

an ink cartridge for storing an ink;

a carrier storage tank for storing a liquid carrier;

a mixing tank, for storing a developing solution obtained by mixing said ink from said ink cartridge and said liquid carrier from said carrier storage tank at a predetermined ratio, located adjacent to said ink cartridge;

a stationary bulkhead interposed between said ink cartridge and said mixing tank;

a first agitating blade rotatably installed in said mixing tank;

a second agitating blade rotatably installed in said ink cartridge opposite said first agitating blade; and an actuator separated from said first and said second agitating blades, for imparting interlocking rotation thereto.

2. The developing solution supplying system for a wet type developer as claimed in claim 1, wherein each of said first and said second agitating blades is a magnetizable body, said first and said second agitating blades are only magnetically coupled, and said actuator comprises:

a magnet member facing one of said first and said second agitating blades; and a driving motor for rotating said magnet member.

3. The developing solution supplying system for a wet type developer as claimed in claim 1, wherein said ink cartridge and said mixing tank are a integrally formed.

4. The developing solution supplying system for a wet type developer as claimed in claim 1, wherein a plurality of first agitating blades are rotatably installed in said mixing tank.

5. A developing solution supplying system for a wet type developer, comprising:

an ink cartridge for storing an ink;

a carrier storage tank for storing liquid carrier;

a mixing tank, for storing a developing solution obtained by mixing said ink from said ink cartridge with said liquid carrier from said carrier storage tank in a predetermined ratio, located adjacent to said ink cartridge;

a stationary bulkhead interposed between said ink cartridge and said mixing tank;

a shaft rotatably installed through said bulkhead, such that a first end of said shaft is provided in said mixing tank and a second end of said shaft is provided in said ink cartridge;

a sealing member for sealing a portion of the bulkhead through which said shaft penetrates;

a first agitating blade installed on said first end of said shaft;

a second agitating blade installed on said second end of said shaft; and an actuator for rotating said first and said second agitating blades.

6. The developing solution supplying system for a wet type developer as claimed in claim 5, wherein at least one of said first and said second blades, rotated by said actuator, is a magnetic body, and said actuator comprises:

a magnet member facing said magnetic body; and a driving motor for rotating said magnet member.

7. The developing solution supplying system for a wet type developer as claimed in claim 5, wherein said ink cartridge and said mixing tank are integrally formed.

8. The developing solution supplying system for a wet type developer as claimed in claim 5, wherein a plurality of first agitating blades are installed on said first end of said shaft.

* * * * *